United States Patent [19]

Hattori

[11] 4,228,859

[45] Oct. 21, 1980

[54] SPRINKLER HEAD HAVING A PLURALITY OF SUPPORTING LEGS

[76] Inventor: Tadashi Hattori, 15-20 1-chome, Kamori-cho, Kishiwada-shi, Osaka-fu, Japan

[21] Appl. No.: 963,021

[22] Filed: Nov. 22, 1978

[30] Foreign Application Priority Data

Jul. 31, 1978 [JP] Japan ..... 53-106867
Jul. 31, 1978 [JP] Japan ..... 53-106868

[51] Int. Cl.[3] ..... A62C 37/08
[52] U.S. Cl. ..... 169/57; 169/40
[58] Field of Search ..... 169/26, 37–42, 169/90, 57; 126/287.5; 137/72

[56] References Cited

U.S. PATENT DOCUMENTS

| | | | |
|---|---|---|---|
| 531,228 | 12/1884 | Storer | 169/40 |
| 2,389,332 | 11/1945 | Tyden | 169/37 |
| 2,502,755 | 4/1950 | Rowley | 169/37 X |
| 2,553,726 | 5/1951 | Rowley | 169/38 |
| 3,525,402 | 8/1970 | Hattori | 169/42 X |
| 3,716,103 | 2/1973 | Tanaka et al. | 169/42 |

*Primary Examiner*—Robert J. Spar
*Assistant Examiner*—Fred A. Silverberg
*Attorney, Agent, or Firm*—George B. Oujevolk

[57] ABSTRACT

A sprinkler head adapted to jet water or fire extinguishing liquid with its valve automatically detached when the room temperature is raised to such extent that there is a danger of the outbreak of a fire or when the room temperature is raised due to the outbreak of a fire in a room inside a general building, wherein a water discharge valve seat is provided in the lower center of a discoidal body, a plurality of supporting legs being formed on the outside or both sides of the valve seat, the valve held in contact with the valve seat being sustained by a heat sensitive sustaining unit comprising a plurality of levers engaged with receivers of the supporting legs, a fusible member and the like, a deflector having a multiplicity of sprinkling outlets being mounted on the lower part of the discoidal body.

1 Claim, 10 Drawing Figures

FIG.8
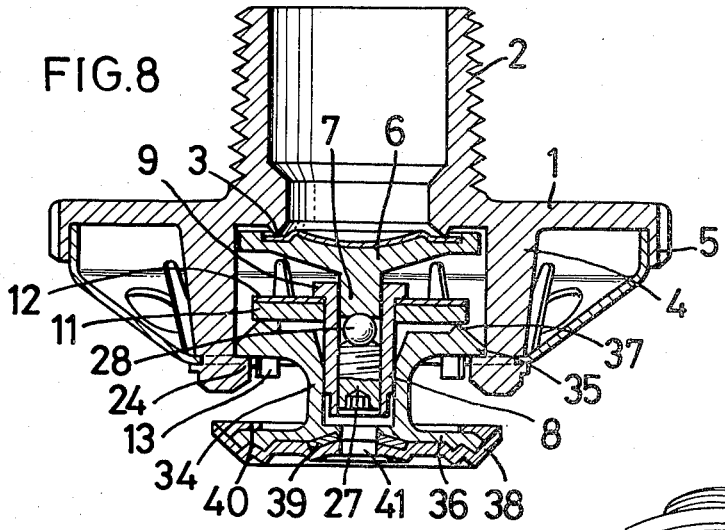
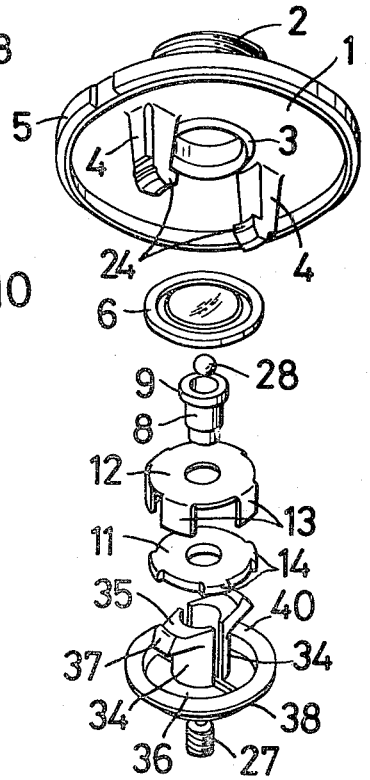
FIG.10
FIG.9
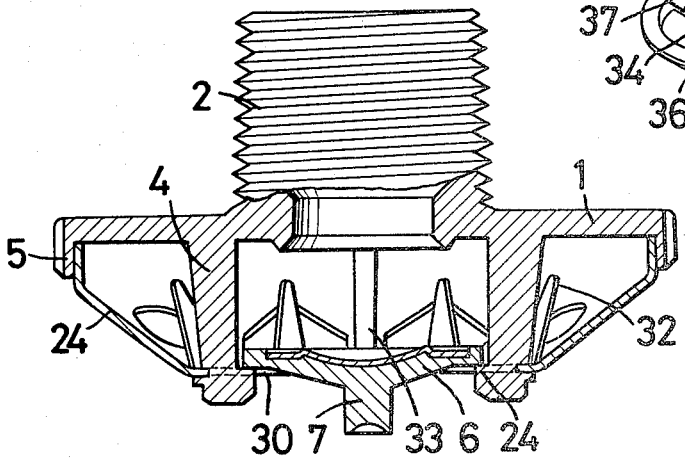

SPRINKLER HEAD HAVING A PLURALITY OF SUPPORTING LEGS

The invention relates to a sprinkler head adapted to jet water or fire extinguishing liquid with its valve automatically detached when the temperature of a room or the like in a general building is raised to such extent that there is a danger of the outbreak of a fire, or when the room temperature is raised due to the outbreak of a fire, thereby enabling to obviate the outbreak of a fire or check a fire from spreading to other buildings. Conventionally, sprinkler heads of this type have been provided in various shapes. However, the sprinkler head according to the invention is characterized in that it is lighter in weight and can be assembled and adjusted with greater simplicity.

Other objects and advantages of the invention will become apparent from the following description taken in connection with the accompanying drawings.

FIG. 8 is a longitudinal sectional view, on a magnified scale, of the same.

FIG. 9 is a longitudinal sectional elevation of the same at the time of sprinkling.

FIG. 10 is a knockdown perspective of the same.

Figure 1:
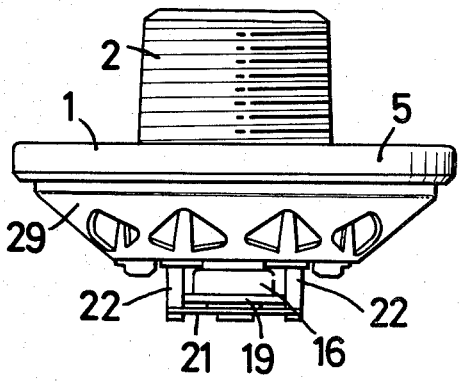
FIG. 1 is an elevational view showing a first embodiment of the sprinkler head according to the invention.
Figure 2:
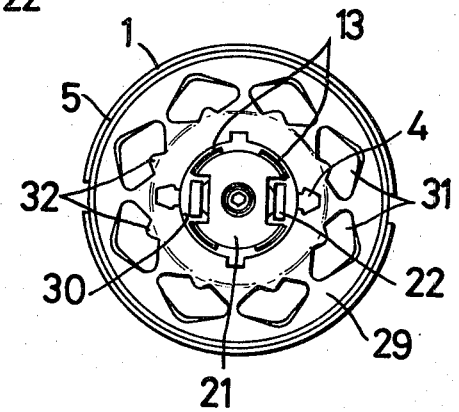
FIG. 2 is an underside view of the same.

Referring to FIGS. 1 to 5 showing the first embodiment, the numeral 1 designates a discoidal body formed by means of casting or the like, a threaded tube 2 for connecting a water pipe thereto being integrally formed in the upper center of the body 1, a water discharge valve seat 3 being formed in the lower center thereof, a supporting leg 4 being integrally formed on each side of the valve seat 3, a downward edge 5 being formed on the outer periphery of the body 1.

The numeral 6 designates a valve, a thin packing made of sheet copper or the like being superposed on the valve 6, a valve spindle being erected in the lower center thereof.

The numeral 8 designates a cylindrical guide sleeve having a flange 9 on the outer periphery of its upper end, the guide sleeve 8 having a smaller diameter below a shoulder 10 provided intermediately on its outer periphery.

The numeral 11 designates an annular spring-guide made of relatively thick elastic sheet metal, a seat plate 12 made of thin sheet metal being superposed thereon, a plurality of downward guide pieces 13 being spaced on the peripheral edge of the seat plate 12, the guide pieces 13 being fitted between a plurality of projections 14 on the outer periphery of the spring-guide 11. The seat plate 12 and the spring-guide 11 are fitted through their central holes externally onto the guide sleeve 8 so as to be supported by the flange 9.

The numeral 15 designates an upper ring fitted externally onto the guide sleeve 8 from under so as to be stopped by the shoulder 10. The numeral 16 designates a lower ring fitted externally onto the guide sleeve 8 through its lower end, an annular fusible member being fitted inside a peripheral wall 17 of the upper outer periphery of the lower ring 16, the lower part of the upper ring 15 loosely fitted inside the peripheral wall 17 being brought into contact with the fusible member 18.

The numeral 19 designates an annular balancer, the balancer 19 being fitted onto the small diameter portion 20 of the lower outside of the lower ring 16, a heat collector 21 made of thin sheet metal being fitted through its central hole onto the lower end of the lower ring 16 and secured thereto by means of caulking or the like. Thus the balancer 19 is permitted to move upwardly and downwardly to a certain extent between the shoulder in the upper part of the small diameter portion and the heat collector 21.

The numeral 22 designates a pair of levers formed with an angle 23 on the outside of the upper end thereof respectively, the top of each angle 23 being brought into contact with the lower part of the outer periphery of the spring-guide 11 while the underside of the outer periphery of each angle 23 is engaged with a receiver 24 provided inside the lower end of each supporting leg 4, a downward hooked supporter 26 erected on each side of the balancer 19 being engaged with an engaging hole 25 in the lower part of each lever 22.

The numeral 27 designates a pressure screw screwed into female threads inside the guide sleeve 8, a ball 28 being interposed between the upper end of the pressure screw 27 and the lower end of the valve spindle 7.

The numeral 29 designates a tapering deflector press-molded from sheet metal, the upward edge of the outer periphery of the deflector 29 being fitted into and secured to the downward edge 5 of the body 1 by means of caulking, by the use of an adhesive, or the like. In the center of the deflector 29 is formed an opening 30 for permitting the heat collector 21, the lower ring 16, the levers 22, etc. to project therethrough, the lower end of each supporting leg 4 being engaged with and secured to each of a pair of notches formed on the periphery of the opening 30 by means of caulking or the like.

A plurality of substantially triangular sprinkling outlets are provided on the deflector 29, a slender triangular projection 32 being provided inside the deflector 29 and adjacent the central hole thereof so as to rise upright from the middle of a side corresponding to the base of each triangular sprinkling outlet 31 thereby enabling to disperse the water. Furthermore, a plurality of guide shafts 33 are erected on a part of the peripheral edge of the opening 30 of the deflector 29 so as to serve together with the inside walls of the supporting legs 4 as guides for the valve 6 at the time of its lowering, the lower ends of the guide pieces 13 of the seat plate 12 being fitted into the opening 30 so as to serve as guides for the spring-guide 11.

Figure 3:
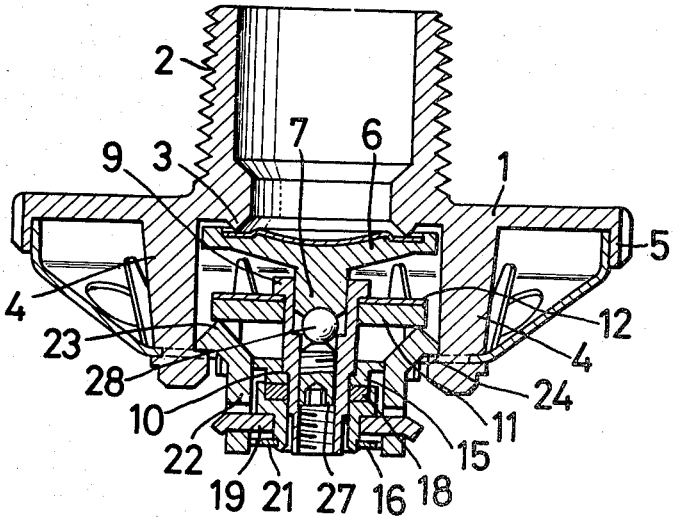
FIG. 3 is a longitudinal sectional elevation, on a magnified scale, of the same.
Figure 4:
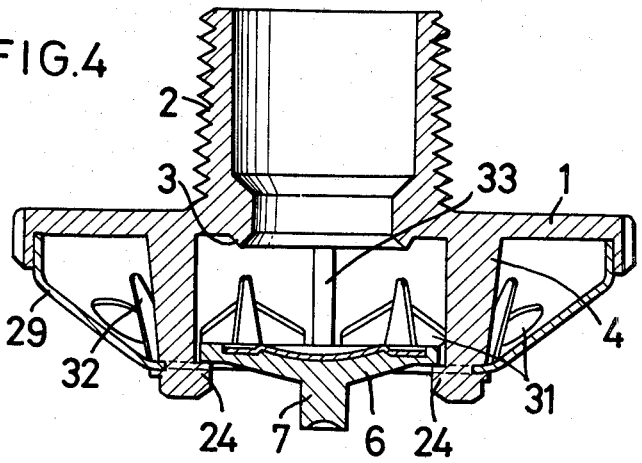
FIG. 4 is a longitudinal sectional elevation of the same at the time of sprinkling.
Figure 5:
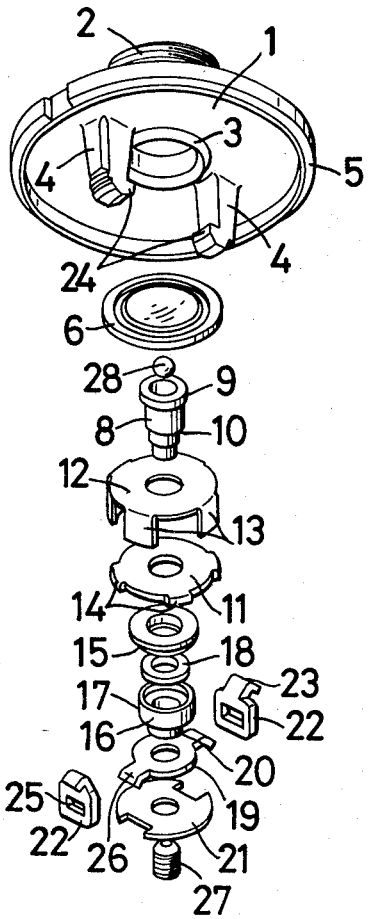
FIG. 5 is a knockdown perspective of the same.
Figure 6:
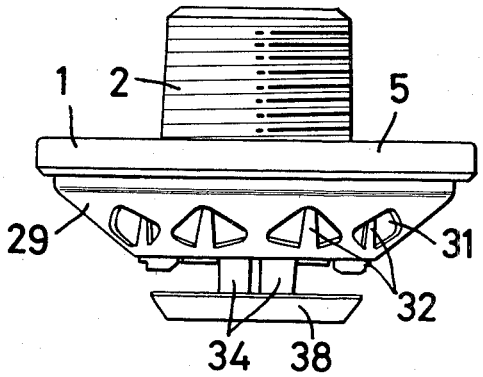
FIG. 6 is an elevational view of a second embodiment of the sprinkler head according to the invention.
Figure 7:
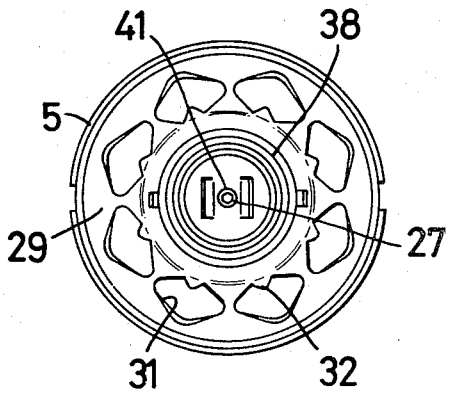
FIG. 7 is an underside view of the same.

In the first embodiment described hereinbefore, the water pressure applied to the valve 6 through the threaded tube 2 is transmitted to the valve spindle 7, the ball 28, the pressure screw 27, and the spring-guide 11 in sequence in the state as shown in FIG. 3, the underside of the outer periphery of the spring-guide 11 pressing downwardly the top of the angle 23 of each lever 22. Thus an extroversive rotary force centering on the contact point between the outer end of the angle 23 and the receiver 24 of the supporting leg 4 is exerted on each lever 22. However, the extroversive force is held in check since the engaging hole 25 at the lower end of each lever 22 is securely engaged with the lower edge of the supporter 26 of the balancer 19 due to the downward pressure transmitted from the shoulder 10 of the guide sleeve 8 to the upper ring 15, the fusible member 18, the lower ring 16 and the balancer 19.

If the fusible member is melted by the heat, for example, due to the outbreak of a fire, the downward pressure applied from the guide sleeve 8 to the upper ring 15, the fusible member, and the lower ring 16 in sequence is intercepted by the liquefaction of the fusible member 18, whereby the lower ring 16 is released. As a result, the supporters 26 of the balancer are disengaged from the engaging holes of the levers 22 thereby permitting the levers 22 to fall downwardly detached from the receivers 24, synchronously the upper and lower rings 15, 16, the guide sleeve 8, the spring-guide 11, the seat plate 12, etc. falling off the opening 30, the valve 6 detached from the valve seat 3 being sustained by the receivers 24, whereby the water discharged from within the valve seat 3 is dispersed in collision with the valve 6 until it is sprinkled through the sprinkling outlets 31 of the deflector 29.

FIGS. 6 to 10 show a second embodiment of the sprinkler head according to the invention.

The numeral 1 designates a discoidal body formed by means of casting or the like, a threaded tube 2 for connecting a water pipe thereto being integrally formed in the upper center of the body 1, a water discharge valve seat 3 being formed in the lower center thereof, a supporting leg 4 being integrally formed on each side of the valve seat 3, a downward edge 5 being formed on the outer periphery of the body 1.

The numeral 6 designates a valve, a thin packing made of sheet copper being superposed on the upper surface of the valve 6, a valve spindle 7 being erected in the lower center thereof.

The numeral 8 designates a cylindrical guide sleeve having a flange on the outer periphery at the upper end thereof, female threads being formed on the inside of the guide sleeve 8.

The numeral 11 designates an annular spring-guide made of relatively thick flexible sheet metal, a seat plate 12 made of thin sheet metal being superposed thereon, a plurality of downward guide pieces 13 being spaced on the peripheral edge of the seat plate 12. The guide pieces 13 are fitted between a plurality of projections 14 on the outer periphery of the spring-guide 11. The seat plate 12 and the spring-guide 11 are fitted through their central holes externally onto the guide sleeve 8 so as to be supported by the flange 9.

The numeral 34 designates a pair of levers each having an upper element 35 and a lower element 36 facing outwardly, the top of an angle 37 at the outer end of the upper element 35 of each lever 34 being adapted to abut the lower part of the outer periphery of the spring-guide 11, the underside of the outer end of each angle 37 being engaged with the receiver provided inside the lower end of each supporting leg 4. The underside of the lower element 36 of each lever 34 is formed with indents, said indents being engaged with corresponding indents formed on a discoidal coupler 38, a skid-proof key being interposed between each lower element 36 and the coupler 38, the lower elements 36 and the coupler 38 being integrally bonded by providing a core ring 40 on the lower elements and pouring the fusible member between the lower elements 36 and the coupler 38.

The numeral 27 designates a pressure screw screwed into the guide sleeve 8 through the opening at its lower end, a ball 28 being interposed between the upper end of the pressure screw 27 and the lower end of the valve spindle 7. On the coupler 38 is formed a through hole 41 for a hexagonal wrench engageable with a hexagonal hole at the lower end of the pressure screw 27.

The numeral 29 designates a tapering deflector press-molded from sheet metal, the upward edge of the outer periphery of the deflector 29 being fitted and secured to the inside of the downward edge of the body 1 by means of caulking, by the use of an adhesive, or the like. The deflector 29 is provided with an opening 30 in its center, the lower end of each supporting leg 4 being engaged with and secured to each of a pair of notches formed on the periphery of the opening 30 by means of caulking or the like. A plurality of substantially triangular sprinkling outlets 31 are provided on the deflector 29, a slender triangular projection being provided inside the deflector and adjacent the central hole thereof so as to rise upright from the middle of a side corresponding to the base of each triangular sprinkling outlet 31 thereby causing the water to disperse. Furthermore, a plurality of guide shafts 33 are erected in a part of the peripheral edge of the opening 30 of the deflector 29 so as to serve as guides together with the inside walls of the supporting legs for the valve 6 at the time of its lowering, the lower end of each guide piece 13 of the seat plate 12 being fitted into the opening 30 so as to serve as a guide for the spring-guide 11.

In the second embodiment as described hereinbefore, the water pressure applied to the valve 6 through the threaded tube 2 in the state as shown in FIG. 8 is transmitted to the valve spindle 7, the ball 28, the pressure screw 27 and the spring-guide 11 in sequence, thus the underside of the outer periphery of the spring-guide 11 pressing downwardly the top of the angle 37 of each lever 34. As a result, an extroversive rotary force centering on the contact point between the outer end of the angle 37 and the receiver 24 of each supporting leg 4 is exerted on each lever 34. However, the levers 34 are precluded from opening outwardly since the lower elements 36 thereof are bonded to the coupler 38 by the fusible member. Thus the valve 6 is held in contact with the valve seat 3.

If the fusible member is melted by the heat, for example, due to the outbreak of a fire, the coupler 38 and the core ring 40 are detached from the lower elements of the levers 34. As a result, the levers 34 fall off the receivers while rotating outwardly, synchronously the spring-guide 11, the seat plate 12 and the like falling off the opening 30, the valve 6 detached from the valve seat 3 being sustained by the receivers 24 as shown in FIG.9. The water discharged from within the valve seat 3 is dispersed in collision with the valve 6 until it is sprinkled through each sprinkling outlet 31 of the deflector 29.

The sprinkler head according to the invention performs the operation as described hereinbefore and differs from the conventional sprinkler head in that it has a discoidal body provided in the lower part thereof with a deflector made of thin sheet metal, the water pressure applied to the valve being sustained by the receivers of the supporting legs. Therefore, it is lighter in weight and producible with a smaller amount of material. It has another advantage in that it is capable of sprinkling over a wider range since the water is sprinkled through a multiplicity of sprinkling outlets provided on the deflector. The heat sensitive unit comprises a fusible member interposed between the upper ring and the lower ring in the first embodiment, while in the second embodiment the lower elements of the levers and the coupler projecting downwardly of the deflector are bonded together by a fusible member, thereby enabling to simplify the construction. Moreover, in the second embodiment, the heat sensitivity is particularly high since the coupler also acts as a heat collector. The sprinkler head according to the invention has a still further advantage in that the pressure can be set simply by fastening the pressure screw screwed into the guide sleeve, that is, the pressure contact between the valve and the valve seat is obtainable with a smaller force than in the case of the conventional sprinkler head which necessitated the manual operation of the large-sized body or the deflector for the pressure setting.

What is claimed is:

1. A sprinkler head, comprising in combination:

(a) a discoidal body (1) with a lower part and a lower center;

(b) a water discharge valve seat (3) in said lower center;

(c) a plurality of supporting legs (4) formed in said lower part so as to be located on both sides of said valve seat (3), said supporting legs having a hook receiver (24) inside the lower end of each supporting leg;

(d) a valve (6) having a lower center held in contact with said valve seat, a valve spindle (7) in said valve lower center, a guide sleeve (8) having an upper and lower end, said upper end being fitted into said valve spindle (7) from under, a pressure screw threaded into said guide sleeve (8), and a valve ball (28) disposed so that said valve (6) is held in pressure contact with said valve seat with the interposition of said ball (28);

(e) a flange (9) on the upper part of said guide sleeve (8), an annular spring-guide (11) fitted externally around the guide sleeve (8), outwardly extending lines (22) with engaging angles (23), said angles having a top disposed to abut the lower part of the outer periphery of said spring-guide (11) and supported by said flange (9), said levers having a lower element (25), said engaging angles (23) being engaged with said hook receiver (24) inside the lower end of each supporting leg;

(f) a fusible element interposed between said lower elements (25) and said levers (22) to maintain said valve in pressure contact with said valve seat;

(g) a deflector (29) made of thin material mounted on the lower part of said body (1).

and (h) a shoulder (10) on said guide sleeve, an upper ring (15) fitted externally onto the lower part of the guide sleeve from under so that its rise beyond a predetermined extent is precluded by said shoulder (10), said upper ring (15) having a lower part, a lower ring (16) with a small diameter portion on the lower outside part of said lower ring, said lower ring being fitted externally onto the lower end of the guide sleeve (8), said lower ring (16) having an upper part, said fusible member (18) being interposed between the lower part of the upper ring (15) and the upper part of the lower ring (16), and an annular balancer (19) having a supporter formed on each side thereof, said annular balancer being fitted externally onto said small diameter portion of the outside lower part of the lower ring (16) and being engaged with the engaging lower aperture (25) of said lever (22).

* * * * *